US007159647B2

(12) United States Patent
Hsu

(10) Patent No.: US 7,159,647 B2
(45) Date of Patent: Jan. 9, 2007

(54) HEAT PIPE ASSEMBLY

(76) Inventor: Hul-Chun Hsu, 6F.-3, No.422, Sec. 2, Liming Rd., Taichung City 408 (TW)

( * ) Notice: Subject to any disclaimer, the term of this patent is extended or adjusted under 35 U.S.C. 154(b) by 87 days.

(21) Appl. No.: 11/043,104

(22) Filed: Jan. 27, 2005

(65) Prior Publication Data

US 2006/0162905 A1 Jul. 27, 2006

(51) Int. Cl.
*F28D 15/04* (2006.01)

(52) U.S. Cl. ..... 165/104.26; 165/104.21

(58) Field of Classification Search ..... 165/104.26, 165/104.33, 104.21; 361/700, 704; 29/890.032
See application file for complete search history.

(56) References Cited

U.S. PATENT DOCUMENTS 3,576,210 A * 4/1971 Trent ..... 165/104.26
3,604,503 A * 9/1971 Feldman et al. ..... 165/96
3,680,189 A * 8/1972 Noren ..... 29/890.032
3,857,441 A * 12/1974 Arcella ..... 165/104.26
4,018,269 A * 4/1977 Honda et al. ..... 165/104.26
5,785,088 A * 7/1998 Pai ..... 138/38
6,227,287 B1 * 5/2001 Tanaka et al. ..... 165/80.4
6,446,706 B1 * 9/2002 Rosenfeld et al. ..... 165/46
6,619,384 B1 * 9/2003 Moon et al. ..... 165/104.26
2005/0269064 A1 * 12/2005 Hsu ..... 165/104.26

FOREIGN PATENT DOCUMENTS

JP 60-259401 * 12/1985 ..... 165/104.26
JP 11-294980 * 10/1999 ..... 165/104.26
JP 2000-74579 * 3/2000 ..... 165/104.26

* cited by examiner

*Primary Examiner*—Allen J. Flanigan

(57) ABSTRACT

A heat pipe assembly includes at least a flattened portion formed on the heat pipe. The internal surface of the heat pipe includes a wick structure attached thereon, and a mesh supporting member disposed therein. The wick structure is compressed on the internal surface of the heat pipe by using the mesh supporting member. The mesh supporting member includes a plurality of radially and axially arranged stripes. The radially and axially arranged stripes are orthogonally stacked, thereby forming mutually communicable working fluid channels in the flattened portion of the heat pipe.

14 Claims, 6 Drawing Sheets

HEAT PIPE ASSEMBLY

BACKGROUND OF THE INVENTION

The present invention relates generally to a heat pipe assembly, and more particularly to a heat pipe assembly having a flattened portion that is composed of vertically and horizontally arranged working fluid channels.

There are innumerable heat transfer elements or devices currently available in the commercial market. Among them, heat pipe assemblies are often adapted for satisfying the cooling and heat transfer needs. The basic structure of a heat pipe assembly includes a pipe body and a wick structure attached to the inner surface of the pipe body. The heat from the heat source is then transferred to a working fluid via the capillary phenomena of the wick structure. The working fluid is then vaporized. The working fluid vapor is afterwards condensed into liquid state and returned to the heat point. By performing such a continuous thermal circle of absorbing and dissipating heat, one can achieve the cooling purpose by using the heat pipe assembly.

However, the state-of-the-art wick structure employs a metallic web or soldering powders as the media for guiding the flow of the working fluid. When the wick structure is made of metallic web, there is insufficient self-support so as to be attached to the inner surface of the pipe body. In particular, the wick structure adjacent the flattened portion is easily disengaged or dismantled when the heat pipe assembly needs to be flattened in order to increase the contact surface area with the cooling element or the heat source, thereby obstructing the flow of the working fluid. For this reason, a supporting member is often disposed in the heat pipe assembly after the heat pipe assembly is flattened. However, the shape of the supporting member is often very complicated. In addition, the supporting member can not be disposed before the heat pipe assembly is flattened. Therefore, an independent manufacturing process is required, which renders the fabrication costly and disadvantageous for mass production.

In light of the above, the inventor of the present invention has developed a new heat pipe so as to solve the problems set forth above.

BRIEF SUMMARY OF THE INVENTION

The present invention is to provide a heat pipe assembly, which includes a supporting member composed of a plurality of radially and axially arrange stripes that are mutually stacked. In this manner, mutually communicable working fluid channels are formed in the flattened portion of the heat pipe. Since the structure of the present invention is quite simple, one can easily increase the contact surface area when the flattened heat pipe is combined with a cooling element or a heat source.

In order to achieve the above and other objectives, the heat pipe assembly of the present invention includes at least a flattened portion formed on the heat pipe. The internal surface of the heat pipe includes a wick structure attached thereon, and a mesh supporting member disposed therein. The wick structure is compressed on the internal surface of the heat pipe by using the mesh supporting member. The mesh supporting member includes a plurality of radially and axially arranged stripes. The radially and axially arranged stripes are orthogonally stacked, thereby forming mutually communicable working fluid channels in the flattened portion of the heat pipe. The communicable working fluid channels provide the working fluid to flow in the heat pipe without directional limitations. Therefore, the above objectives are achieved.

DETAILED DESCRIPTION OF THE INVENTION

In order to better understanding the features and technical contents of the present invention, the present invention is hereinafter described in detail by incorporating with the accompanying drawings. However, the accompanying drawings are only for the convenience of illustration and description, no limitation is intended thereto.

Figure 9:
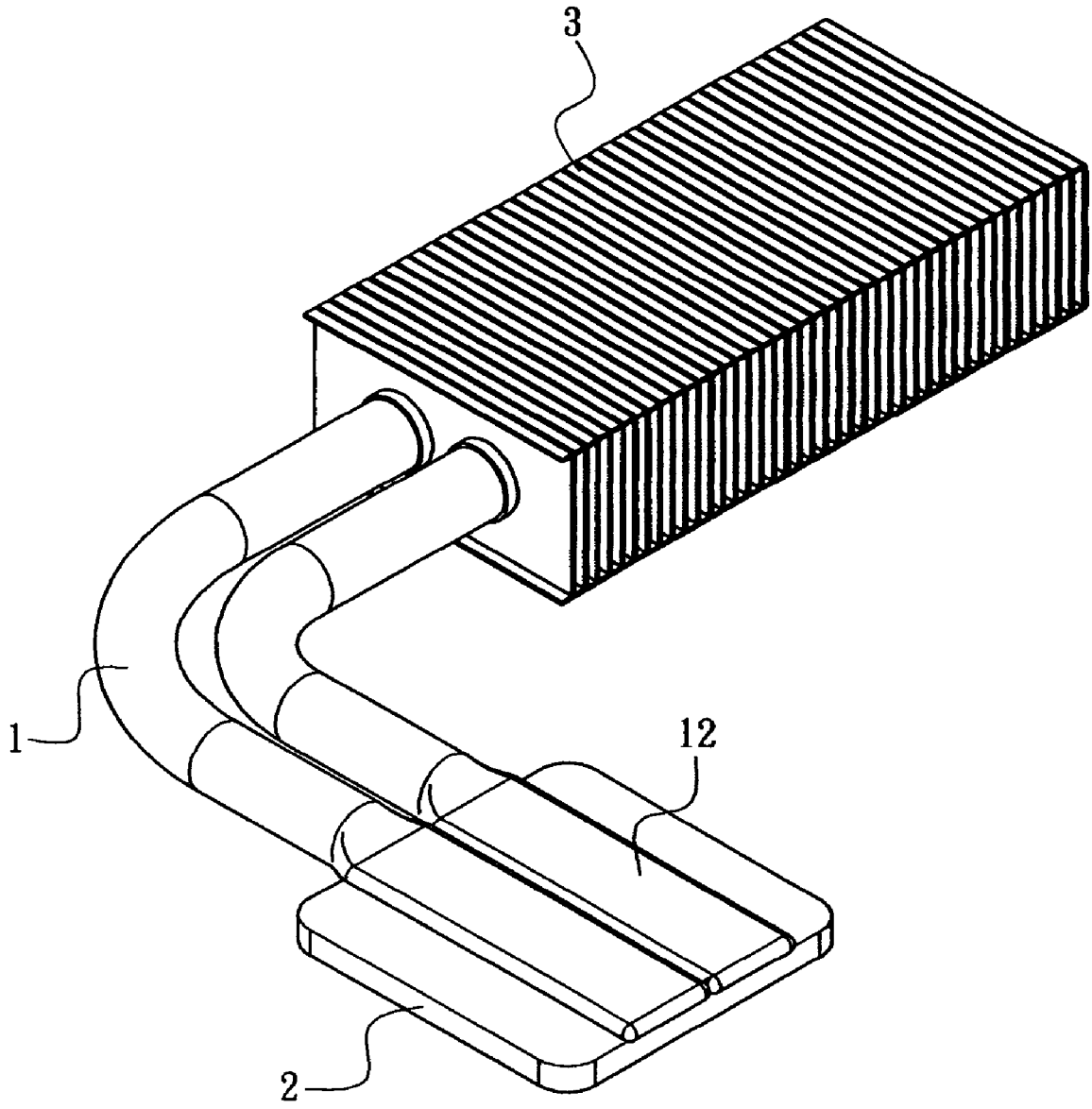
FIG. 9 illustrates the heat pipe assembly of the present invention in use.

Referring first to FIG. 9, the heat pipe assembly of the present invention in use is illustrated. The heat pipe assembly of the present invention includes a heat pipe 1 having at least a flattened portion 12 so as to contact the heat transfer base 2 with a larger contact surface area. The other end of the heat pipe 1 can still connect with a plurality of cooling fins 3 for satisfying the cooling needs.

Figure 2:
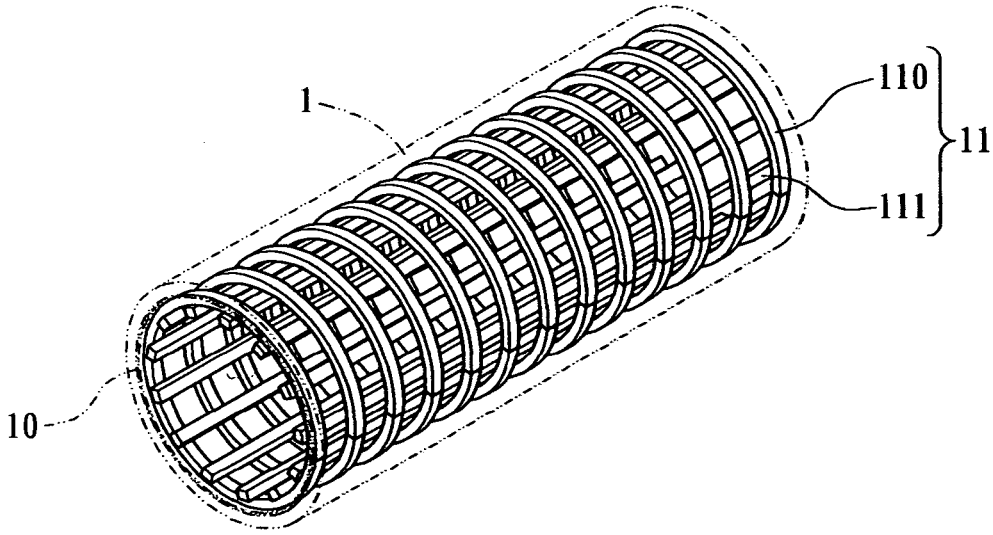
FIG. 2 is a perspective view illustrating a partially manufactured heat pipe assembly of the present invention before being flattened.
Figure 3:
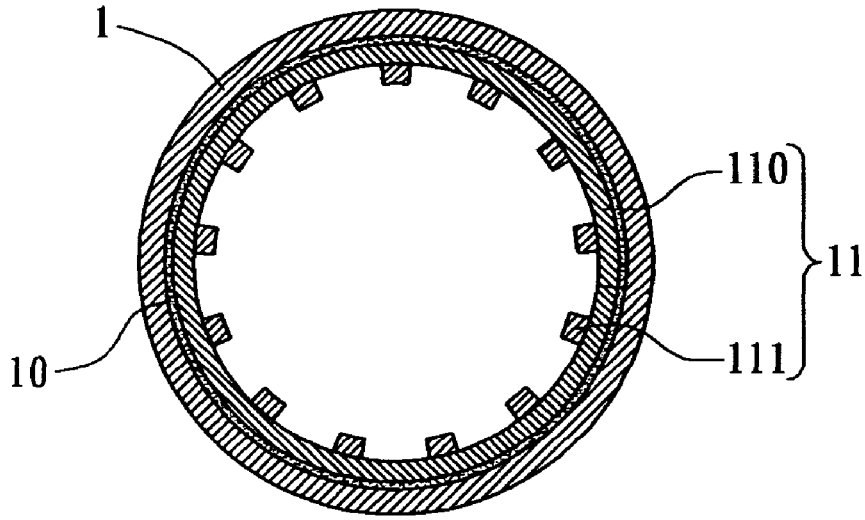
FIG. 3 illustrates a sectional view of the partially manufactured heat pipe assembly before being flattened, in accordance with the first embodiment of the present invention.
Figure 4:
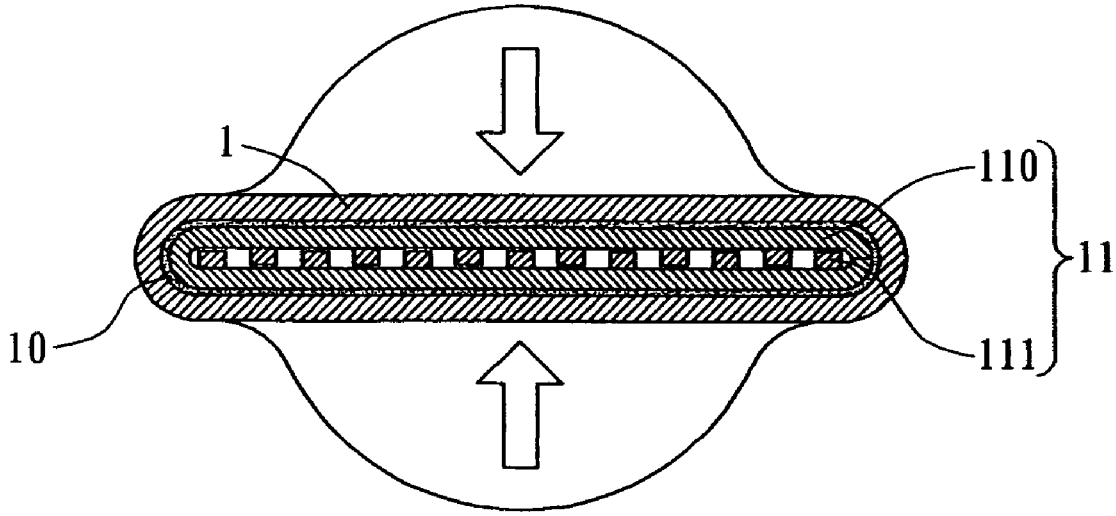
FIG. 4 illustrates a sectional view of the partially manufactured heat pipe assembly after being flattened, in accordance with the first embodiment of the present invention.
Figure 5:
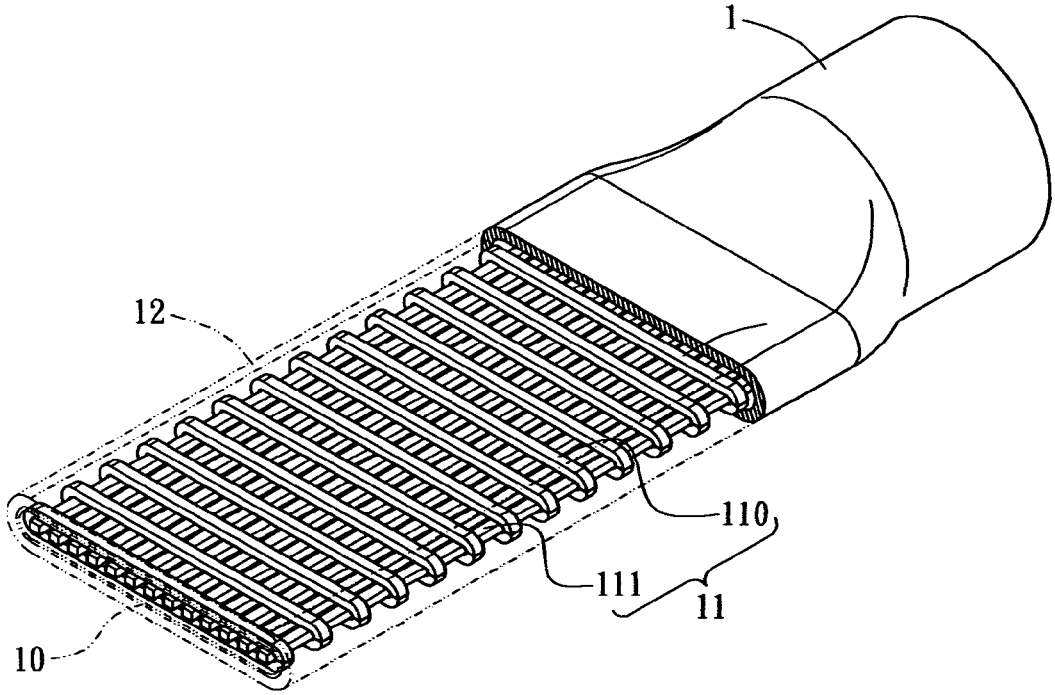
FIG. 5 is a perspective view illustrating the flattened portion of the heat pipe assembly, in accordance with the first embodiment of the present invention.
Figure 6:
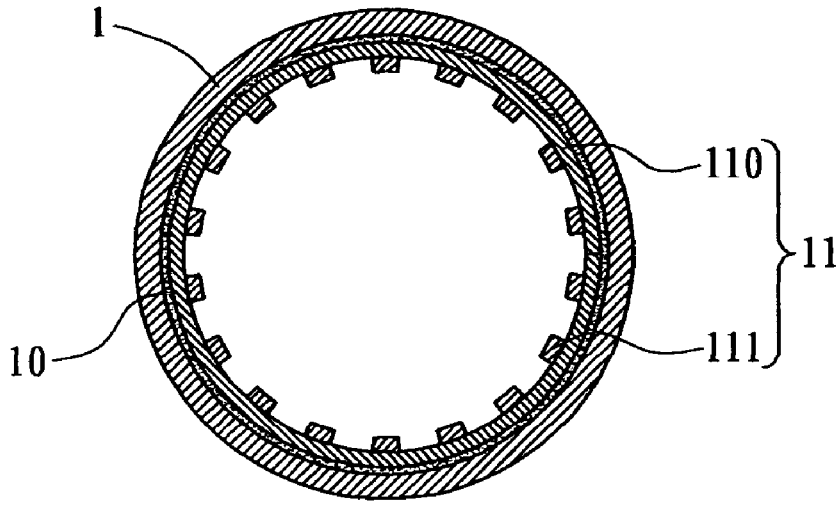
FIG. 6 illustrates a sectional view of the partially manufactured heat pipe assembly before being flattened, in accordance with the second embodiment of the present invention.

As shown in FIG. 4 and FIG. 5, the flattened portion 12 of the heat pipe 1 is flattened from the cylindrical pipe body. As shown in FIG. 2 and FIG. 3, the flattened portion 12 is a hollow cylinder like the other portion of the heat pipe 1 before being flattened. A wick structure 10 made of metallic web and a mesh supporting member 11 for compressing the wick structure 10 onto the inner surface of the heat pipe 1 are attached to the inner surface of the heat pipe 1.

Figure 1:
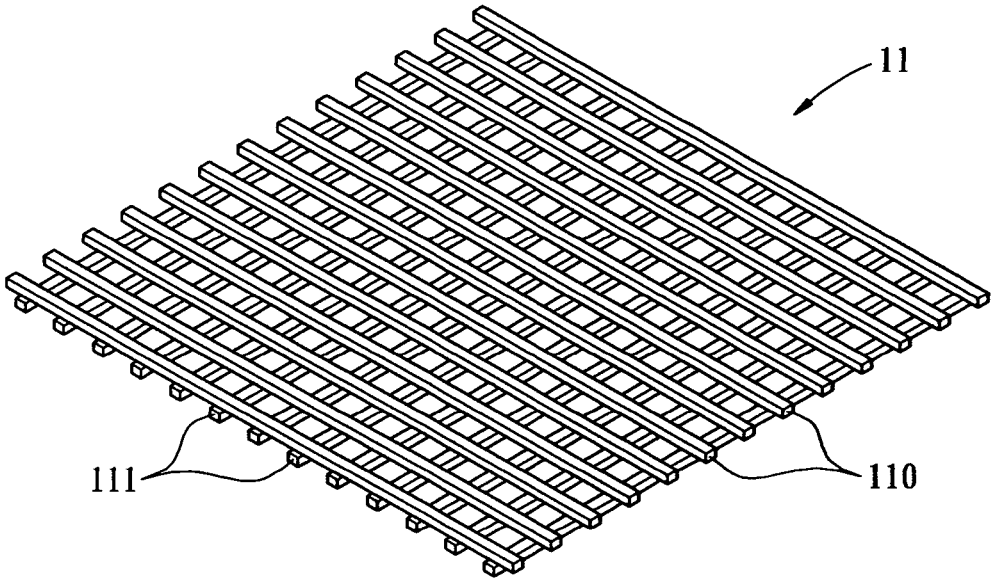
FIG. 1 is a perspective view illustrating a mesh supporting member of the present invention.

As shown in FIG. 1, the mesh supporting member 11 includes a plurality of radially and axially arranged stripes 110, 111. The radially and axially arranged stripes 110, 111 are mutually and orthogonally stacked, but not mutually interwoven. The cross section of the radially and axially arranged stripes 110, 111 can be rectangular, circular, trapezoidal or triangular. In addition, the geometrical dimension of the radially and axially arranged stripes 110, 111 can be inhomogeneous. For example, the cross section area of the radially arranged stripes 110 can be larger than that of the axially arranged stripes 111. In addition, the cross sections of the radially and axially arranged stripes 110, 111 can be of different shapes. Moreover, the radially or axially arranged strips 110, 111 can be equally spaced or unequally spaced. Furthermore, the crossing points of the radially and axially arranged stripes 110, 111 can be combined by employing the point soldering technique, thereby forming a mesh supporting member 11.

Referring to FIG. 3 to FIG. 5, the cylindrical heat pipe 1, which includes the wick structure 10 and the mesh supporting member 11, is flattened by pressing the portion to be flattened using a compressor (not shown). At the mean time, the shape of the wick structure 10 and the mesh supporting member 11 is also deformed. In this particular embodiment, the axially arranged stripes 111 at the upper portion of the mesh supporting member 11 are misaligned with that at the lower portion, as shown in FIG. 4.

Since the radially and axially arranged stripes 110, 111 are equally spaced, a plurality of channels for flowing therethrough the working fluid are vertically and horizontally formed in the flattened portion of the heat pipe 1. Thereby, the working fluid can flow in the heat pipe 1 without directional limitations, thus preventing the supporting member from blocking the flow of the working fluid. In addition, the flowing speed of the working fluid is enhanced, thereby obtaining a heat pipe 1 having a flattened portion 12 with better heat transfer efficiency. Meanwhile, since the mesh supporting member 11 is disposed into the heat pipe 1 before the cylindrical heat pipe 1 is flattened, the wick structure 10 is better compressed onto the inner surface of the heat pipe 1 by using the supporting member 11. Therefore, one can manufacture the supporting member 11 together with the wick structure 10. In this manner, the internal structure of the heat pipe 1 will become more stable, and the manufacturing cost lower.

In addition, the mesh supporting member 11 can also be a structure having capillary force. The structure having capillary force refers to soldering powders or a metallic web, for example.

Therefore, the heat pipe assembly of the present invention is obtained.

Figure 7:
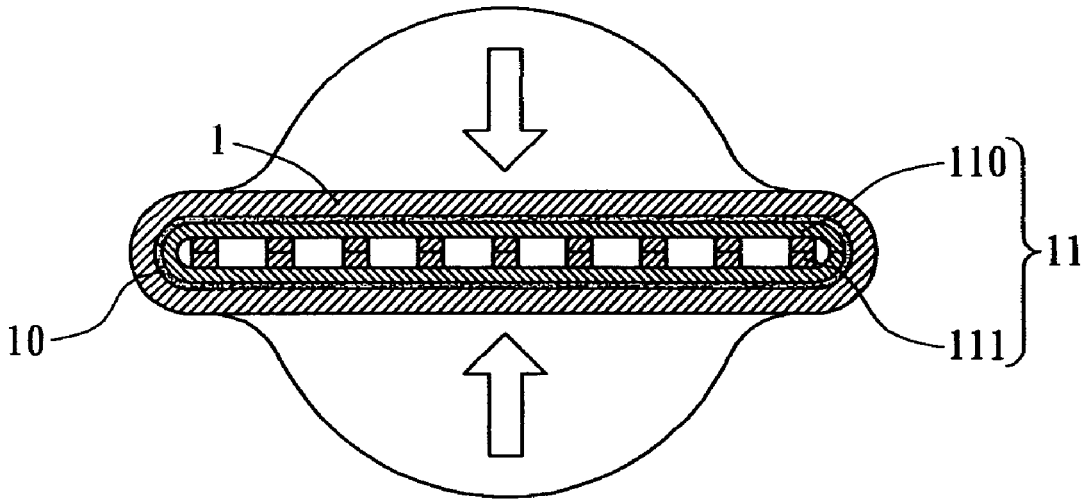
FIG. 7 illustrates a sectional view of the partially manufactured heat pipe assembly after being flattened, in accordance with the second embodiment of the present invention.
Figure 8:
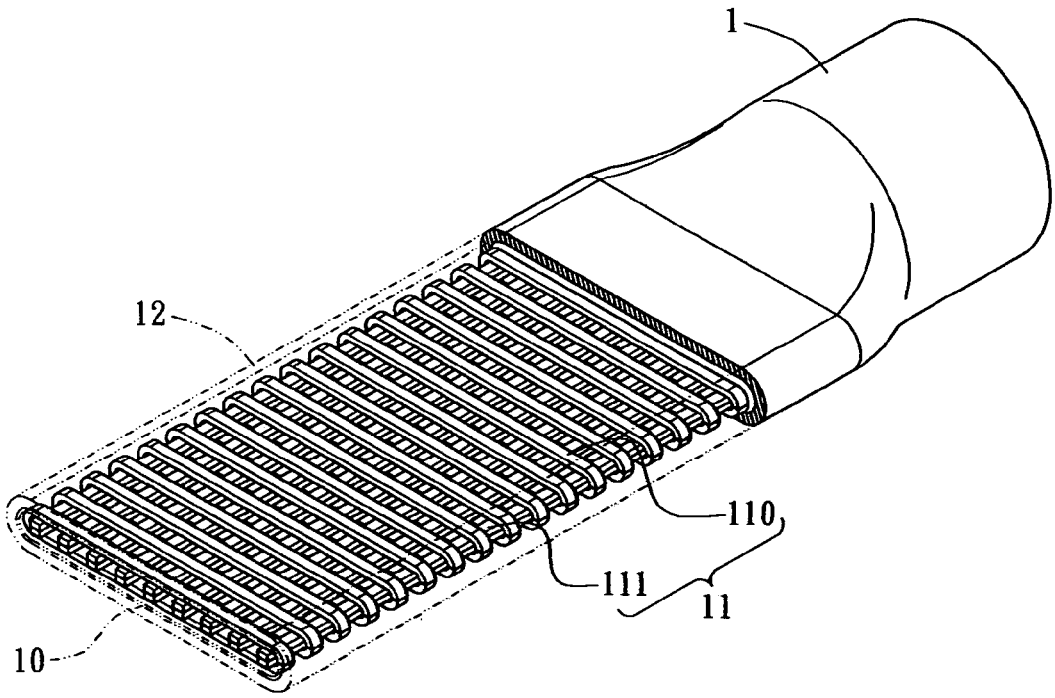
FIG. 8 is a perspective view illustrating the flattened portion of the heat pipe assembly, in accordance with the second embodiment of the present invention.

Further, referring to FIG. 7, FIG. 8 and FIG. 9, sectional views of the heat pipe assembly before and after being flattened, in accordance with the second embodiment of the present invention, are illustrated. In this particular embodiment, the axial stripes 111 at the upper portion of the mesh supporting member 11 are aligned with that at the lower portion, as shown in FIG. 7. Other features of the second embodiment are the similar to that of the first embodiment, the discussion of which is thus omitted.

In summary, the heat pipe assembly of the present invention can solve the problems as set forth above. In addition, the heat pipe assembly of the present invention can indeed satisfy the patentability requirements of the patent law, a grant of letters patent is therefore respectfully requested.

Since, any person having ordinary skill in the art may readily find various equivalent alterations or modifications in light of the features as disclosed above, it is appreciated that the scope of the present invention is defined in the following claims. Therefore, all such equivalent alterations or modifications without departing from the subject matter as set forth in the following claims is considered within the spirit and scope of the present invention.

What is claimed is:

1. A heat pipe assembly comprising;

a heat pipe enclosing space for working fluid, at least a portion of said heat pipe enclosing said space being flattened, a metallic web wick structure compressed and attached to the internal surface of the heat pipe by a mesh supporting member disposed against the wick structure, said mesh supporting member comprising a nonwoven combination of strips;

said strips comprising a first layer of radially extending discrete strips spaced from each other along the axis of the heat pipe, and a second layer of axially extending strips disposed generally orthogonally to the radially extrending strips;

said nonwoven combination of strips forming mutually communicable working fluid channels in the flattened portion of the heat pipe.

2. The heat pipe assembly as recited in claim 1, wherein the mesh supporting member comprises a structure having capillary forces.

3. The heat pipe assembly as recited in claim 2, wherein the structure having capillary forces comprises soldering powders.

4. The heat pipe assembly as recited in claim 1, wherein the axially arranged stripes of the mesh supporting member at the upper and lower portion of the flattened portion are mutually misaligned.

5. The heat pipe assembly as recited in claim 1, wherein the axially arranged stripes of the mesh supporting member at the upper and lower portion of the flattened portion are mutually aligned.

6. The heat pipe assembly as recited in claim 1, wherein the cross section of the radially and axially arranged stripes is rectangular.

7. The heat pipe assembly as recited in claim 1, wherein the cross section of the radially and axially arranged stripes is circular.

8. The heat pipe assembly as recited in claim 1, wherein the cross section of the radially and axially arranged stripes is trapezoidal.

9. The heat pipe assembly as recited in claim 1, wherein the cross section of the radially and axially arranged stripes is triangular.

10. The heat pipe assembly as recited in claim 1, wherein the radially and axially arranged stripes are equally spaced.

11. The heat pipe assembly as recited in claim 1, wherein the radially and axially arranged stripes are unequally spaced.

12. The heat pipe assembly as recited in claim 1, wherein the geometrical dimension of the radially and axially arranged stripes in inhomogeneous.

13. The heat pipe assembly a recited in claim 12, wherein the cross section area of the radially arranged stripes is large that of the axially arranged stripes.

14. The heat pipe assembly as recited in claim 12, wherein the radially and axially arranged stripes comprise cross section area of different shapes.

* * * * *